US008919237B1

(12) United States Patent
Hooks

(10) Patent No.: US 8,919,237 B1
(45) Date of Patent: Dec. 30, 2014

(54) TACTICAL MAINTENANCE CURTAIN

(71) Applicant: Glenn Hooks, Lawton, OK (US)

(72) Inventor: Glenn Hooks, Lawton, OK (US)

(73) Assignee: The United States of America as Represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 13/986,625

(22) Filed: May 20, 2013

(51) Int. Cl.
*F41H 7/00* (2006.01)
*F41H 5/04* (2006.01)

(52) U.S. Cl.
CPC ..... *F41H 5/0492* (2013.01)
USPC ..... 89/36.07; 89/36.01; 89/920

(58) Field of Classification Search
CPC ..... F41H 5/06; F41H 5/08
USPC ..... 89/36.07, 36.04, 36.01, 36.02, 920
See application file for complete search history.

(56) References Cited

U.S. PATENT DOCUMENTS

| | | | | |
|---|---|---|---|---|
| 5,939,658 | A | 8/1999 | Muller | |
| 6,807,890 | B1 * | 10/2004 | Fuqua | 89/36.02 |
| 7,980,166 | B1 * | 7/2011 | Fuqua et al. | 89/36.07 |
| 8,186,109 | B2 | 5/2012 | Warminsky et al. | |
| 8,201,270 | B2 * | 6/2012 | Lee | 2/22 |
| 8,245,622 | B2 | 8/2012 | Anderson et al. | |
| 8,342,073 | B2 | 1/2013 | Chu et al. | |
| 2008/0121100 | A1 * | 5/2008 | Pastrnak et al. | 89/36.09 |
| 2012/0174763 | A1 * | 7/2012 | Ritchie et al. | 89/36.04 |
| 2012/0240758 | A1 | 9/2012 | Cohen | |

* cited by examiner

*Primary Examiner* — J. Woodrow Eldred
(74) *Attorney, Agent, or Firm* — Fredric J. Zimmerman

(57) ABSTRACT

A panel, a tactical maintenance curtain system, and a method includes a plurality of first panels, where each of the plurality of first panels are rectangular; a plurality of second panels, where each of the plurality of second panels are disposed between a pair of the plurality of first panels via lap joints, and where each of the plurality of second panels are rectangular; and at least two webbing straps containing each of the plurality of first panels and the plurality of second panels; where each of the plurality of first panels, the plurality of second panels, and the at least two webbing straps are constructed of a material providing suitable impact protection from bullets and blast fragments.

17 Claims, 5 Drawing Sheets

TACTICAL MAINTENANCE CURTAIN

STATEMENT OF GOVERNMENT INTEREST

The present invention described herein may be manufactured and used by or for the Government of the United States of America for government purposes without the payment of any royalties thereon or therefore.

FIELD OF THE INVENTION

The present disclosure relates generally to armor systems and methods. More particularly, the present disclosure relates to a tactical maintenance curtain that forms a selectively configurable protective barrier.

BACKGROUND OF THE INVENTION

Military personnel in combat zones require protection from enemy weapons. Further, munitions and the like also require protection from weapon fire and the like. Conventionally, military personnel are wearing protective body armor to reduce risk of injuries. Body armor is generally protecting clothing, designed to absorb and/or deflect slashing, bludgeoning, and penetrating attacks. In addition to military personnel, body armor can be used to protect police forces, private citizens and private security guards or bodyguards. Body armor can include metal or ceramic plates in battle-dress, providing additional protection from rifle rounds. Metallic components or tightly-woven fiber layers can give soft armor resistance to stab and slash attacks from a knife. Mail armor continues to be used as protection against stab/slash attacks.

For personal body armor, Kevlar™ is well known as a component of some bullet resistant vests and bullet resistant face masks. Kevlar is a product name and trademark for a para-aramid synthetic fiber, related to other aramids such as Nomex and Technora and was developed at DuPont in 1965. Various helmets and vests used by United States military forces since the early 1980s both have Kevlar™ as a key component, as do their replacements. Other military uses include bullet resistant facemasks used by sentries. Kevlar™ in non-woven long strand form is used inside an outer protective cover to form chaps that loggers use while operating a chainsaw. If the moving chain contacts and tears through the outer cover, the long fibers of Kevlar™ tangle, clog, and stop the chain from moving as they get drawn into the workings of the drive mechanism of the saw. The latest Kevlar™ material that DuPont has developed is Kevlar XP. In comparison with 'normal' Kevlar™, Kevlar™ XP is more light-weight and more comfortable to wear, as it is quilt stitch is not required for the ballistic package. Another fiber used to manufacture a bullet resistant vest is Dyneema™ which is a lightweight high-strength oriented-strand gel spun through a spinneret. Dyneema™ has an extremely high strength-to-weight ratio (a 1-mm-diameter rope of Dyneema™ can bear up to a 240-kg load), is light enough that it can float on water, and has high energy absorption characteristics. Dyneema™ is a polyethylene fiber.

However, there can be situations where it is not feasible for personnel to wear protective body armor while still in harm's way in a combat area or the like. For example, while in a combat zone, personnel may need to perform maintenance in a small area which does not allow the personnel to wear protective body armor. One such example can include performing setup and maintenance on a Land-Based Phalanx Weapon System (LPWS). For example, the LPWS is a Counter Rocket, Artillery, and Mortar, abbreviated C-RAM or Counter-RAM, that is a system used to detect and/or destroy incoming artillery, rockets and mortar rounds in the air before they hit their ground targets, or simply provide early warning. AN LPWS can be mobile as well, mounted, for example, on a flatbed trailer or the like. Disadvantageously, maintenance and setup in an LPWS or other C-RAM is in a small, confined, and unprotected area. As such, it is not possible for field personnel to wear protective armor during these activities which could take several hours. Other equipment can also have these same limitations such as field-based radar systems and other weapons.

Furthermore, conventional body armor is not as effective with personnel performing maintenance and setup in dangerous areas. In particular, the design of conventional body armor is meant to protect a user's chest. While performing maintenance and setup in dangerous, personnel are in movement and exposed, i.e. not standing straight with the chest exposed, but exposing various body areas based on positioning.

Accordingly, there also is a need for portable protective armor that is not necessarily worn, but effective in protecting personnel as well as objects such as munitions in the field. Such portable protective armor would be easy to set up, be portable in nature, selectively configurable, and configured to provide protection over a specific area.

BRIEF SUMMARY OF THE INVENTION

In various exemplary embodiments, portable protective armor is described that is not necessarily worn, but effective in protecting personnel as well as objects such as munitions in the field. Such portable protective armor would be easy to set up, be portable in nature, selectively configurable, and configured to provide protection over a specific area. The portable protective armor can be referred to herein as a tactical maintenance curtain that includes various panels (constructed on poly/Kevlar™) inserted into Kevlar™ webbing to form a selectively configurable protective barrier. The construction of the portable protective armor can include, without limitation, para-aramid synthetic fibers, polyethylene fibers, lightweight high-strength oriented-strand gel spun through a spinneret, and the like. The configurable protective barrier is used to protect personnel and/or munitions. An exemplary application includes protecting personnel in battlefield situations where personnel cannot wear protective body armor such as while performing setup and maintenance on a Land-Based Phalanx Weapon System (LPWS) or the like. The selectively configurable protective barrier can be formed in various configurations.

In an exemplary embodiment, a panel includes a plurality of first panels, wherein each of the plurality of first panels are rectangular; a plurality of second panels, wherein each of the plurality of second panels are disposed between a pair of the plurality of first panels via lap joints, and wherein each of the plurality of second panels are rectangular; and at least two webbing straps containing each of the plurality of first panels and the plurality of second panels; wherein each of the plurality of first panels, the plurality of second panels, and the at least two webbing straps are constructed of a material providing suitable impact protection from bullets and blast fragments. Each of the plurality of first panels and each of the plurality of second panels can be selectively moveable based on the lap joints and the at least two webbing straps for positioning in a plurality of configurations. Each of the plurality of first panels can include a length substantially greater than a height and a width substantially less than the height and width.

Each of the plurality of second panels can include a length substantially greater than a height and a width substantially less than the height and width. Each of the plurality of first panels can be substantially wider than each of the plurality of second panels with about a same length. Each of the plurality of first panels, the plurality of second panels, and the at least two webbing straps can be constructed of any of para-aramid synthetic fibers, polyethylene fibers, lightweight high-strength oriented-strand gel spun through a spinneret. The panel can further include a connector attached to the at least two webbing straps. The connector may be adapted to connect to a door of a field-based system for protection of personnel performing maintenance and setup therein. The panel may further include a ratchet attached to the at least two webbing straps. The plurality of first panels may include N panels, N being an integer and the plurality of second panels comprise N−1 panels. A length, width, and height of each of the plurality of first panels and the plurality of second panels may be selected such that the panel is portable, configurable, and capable of providing suitable impact protection from bullets and blast fragments.

In another exemplary embodiment, a tactical maintenance curtain system may include a plurality of first panels, where each of the plurality of first panels are rectangular; a plurality of second panels, where each of the plurality of second panels are disposed between a pair of the plurality of first panels via lap joints, and where each of the plurality of second panels are rectangular; at least two webbing straps containing each of the plurality of first panels and the plurality of second panels; and a connector attached to the at least two webbing straps, where the connector is adapted to connect to a door of a field-based system for protection of personnel performing maintenance and setup therein; where each of the plurality of first panels, the plurality of second panels, and the at least two webbing straps are constructed of a material providing suitable impact protection from bullets and blast fragments. Each of the plurality of first panels and each of the plurality of second panels may be selectively moveable based on the lap joints and the at least two webbing straps for positioning in a plurality of configurations. Each of the plurality of first panels may include a length substantially greater than a height and a width substantially less than the height and width.

Each of the plurality of second panels may include a length substantially greater than a height and a width substantially less than the height and width. Each of the plurality of first panels may be substantially wider than each of the plurality of second panels with about a same length. Each of the plurality of first panels, the plurality of second panels, and the at least two webbing straps may be constructed of any of para-aramid synthetic fibers, polyethylene fibers, lightweight high-strength oriented-strand gel spun through a spinneret. The plurality of first panels may include N panels, N being an integer and the plurality of second panels comprise N−1 panels. A length, width, and height of each of the plurality of first panels and the plurality of second panels can be selected such that the panel is portable, configurable, and capable of providing suitable impact protection from bullets and blast fragments.

In yet another exemplary embodiment, a method includes providing a panel including a plurality of first panels, where each of the plurality of first panels are rectangular; a plurality of second panels, where each of the plurality of second panels are disposed between a pair of the plurality of first panels via lap joints, and wherein each of the plurality of second panels are rectangular; and at least two webbing straps containing each of the plurality of first panels and the plurality of second panels; wherein each of the plurality of first panels, the plurality of second panels, and the at least two webbing straps are constructed of a material providing suitable impact protection from bullets and blast fragments; and configuring the panel at a location to provide the suitable impact protection.

BRIEF DESCRIPTION OF THE DRAWINGS

The present disclosure is illustrated and described herein with reference to the various drawings, in which like reference numbers are used to denote like system components/method steps, as appropriate, and in which.

DETAILED DESCRIPTION OF THE INVENTION

Again, in various exemplary embodiments, portable protective armor is described that is not necessarily worn, but effective in protecting personnel as well as objects such as munitions in the field. Such portable protective armor would be easy to set up, be portable in nature, selectively configurable, and configured to provide protection over a specific area. The portable protective armor may be referred to herein as a tactical maintenance curtain that includes various panels (constructed on poly/Kevlar™) inserted into Kevlar™ webbing to form a selectively configurable protective barrier. The construction of the portable protective armor may include, without limitation, para-aramid synthetic fibers, polyethylene fibers, lightweight high-strength oriented-strand gel spun through a spinneret, and the like. The configurable protective barrier is used to protect personnel and/or munitions. An exemplary application includes protecting personnel in battlefield situations where personnel cannot wear protective body armor such as while performing setup and maintenance on a Land-Based Phalanx Weapon System (LPWS) or the like. The selectively configurable protective barrier may be formed in various configurations.

Figure 1:
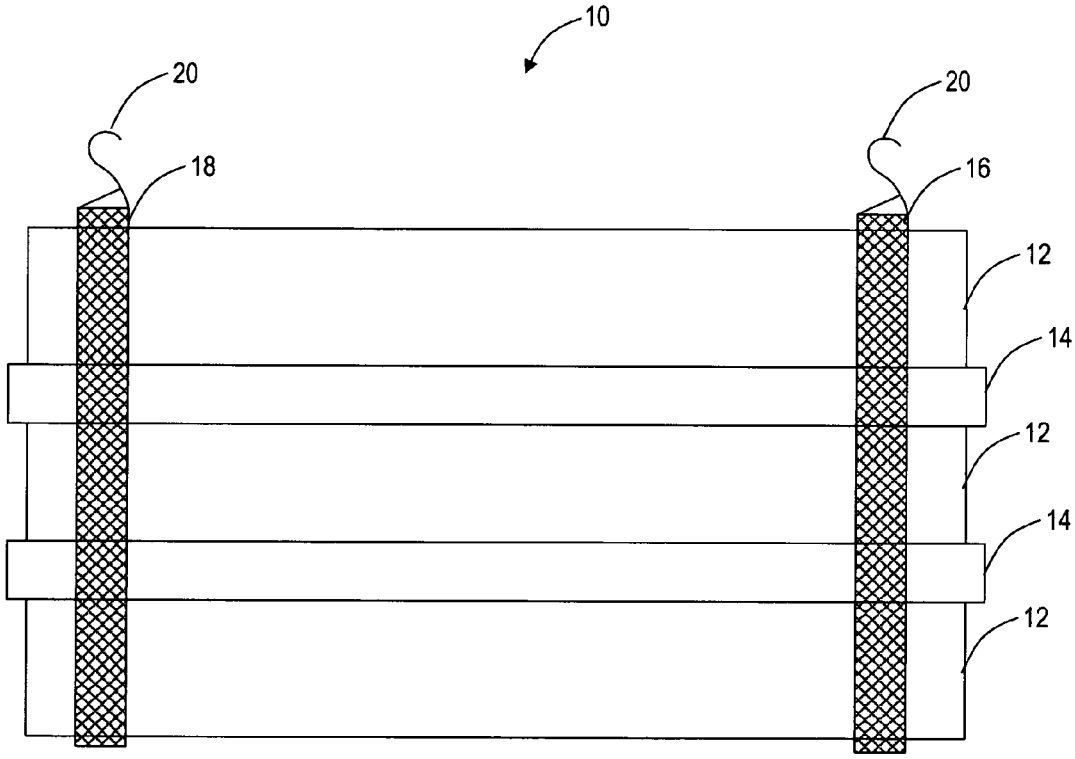
FIG. 1 is a schematic diagram illustrates a frontal view of a panel associated with a tactical maintenance curtain system.

Referring to FIG. 1, in an exemplary embodiment, a schematic diagram illustrates a frontal view of a panel 10 associated with a tactical maintenance curtain system. The panel 10 is formed from a plurality of first panels 12 that are interconnected by a second plurality of second panels 14. Each of the second plurality of second panels 14 connect to lap joints of adjacent first panels 12. A lap joint is a technique of joining two pieces of material together by overlapping them. A lap may be a full lap or half lap. In a full lap, no material is removed from either of the panels 12, 14 to be joined, resulting in a joint which is the combined thickness of the two panels 12, 14. In a half lap joint, material is removed from one or both of the panels 12, 14 so that the resulting joint is the thickness of the thickest panels 12, 14. In an exemplary embodiment, the lap joint between the first panel 12 and the second panel 14 is a half lap joint with the joint having at least a thickness that is substantially the same as a thickness of either the first panel 12 or the second panel 14. In this manner, the panel 10 is flexible for positioning in various configurations.

Despite being flexible, the first panels 12 and the second panels 14 are each formed from a strong material capable of withstanding bullets, blast fragments, etc. In an exemplary embodiment, the panels 12, 14 may include, without limitation, Kevlar™, para-aramid synthetic fibers, polyethylene fibers, lightweight high-strength oriented-strand gel spun through a spinneret, and the like. The panels 12, 14 may include a thickness that is thick enough for protection while thin enough for portability and storage. In an exemplary embodiment, the panels 12, 14 may be about 1 to about 2 inches thick. In another exemplary embodiment, the panels 12, 14 may be about 1.25 inches thick.

The first panels 12 and the second panels 14 with their associated lap joints are kept in place in the panel 10 via webbing material 16, 18. In an exemplary embodiment, the webbing material 16, 18 is formed from similarly strong materials as the panels 12, 14 so as to prevent areas of weakness in the panel 10. Thus, the webbing material 16, 18 can include, without limitation, Kevlar™, para-aramid synthetic fibers, polyethylene fibers, lightweight high-strength oriented-strand gel spun through a spinneret, and the like. The webbing material 16, 18 include openings through which each of the panels 12, 14 is slid therethrough and accordingly held in place. Thus, the panel 10 may be selectively configured in different shapes based on the lap joints and the webbing material 16, 18.

In an exemplary embodiment, the panel 10 may include at least two webbing materials 16, 18 although more may be used in other implementations. In an exemplary embodiment, the panel 10 may include at least two of the panels 14 and at least three of the panels 14. In this manner, the panel 10 may be used in a specific exemplary embodiment for the LPWS protection described herein. In other exemplary embodiments, the panel 10 may have arbitrary number of panels 12, 14. The panel 10 may include N panels 12 and correspondingly includes N−1 panels 14 where N is an integer. Here, the panel 10 may be used in a universal configuration with is also described herein.

Each of the first panels 12 and the second panels 14 are substantially rectangular in shape with a length significantly larger than a height. In this manner, the panel 10 may form a larger rectangle that is flexible for forming a variety of configurations. In a specific exemplary embodiment, the first panels 12 are about 6'×2' in dimensions and the second panels 14 are about 6'×4" in dimensions. In another specific exemplary embodiment, the first panels 12 are about 6'×7" in dimensions and the second panels 14 are about 6'×4" in dimensions. Of course, the panel 10 contemplates other dimensions as appropriate for a specific application.

The webbing material 16, 18 may include hooks 20 or other types of attachment mechanisms. Additionally, the webbing material 16, 18 may connect to the other types of attachment mechanisms for various different configurations. In an exemplary embodiment, the panel 10 is contemplated for use with a LPWS as a tactical maintenance curtain for performing setup and maintenance thereon. For the LPWS application, the panel 10 requires some unique cuts due to the shape of an open barbette door. Specifically, here the panel 10 is placed over the open barbette door of an LPWS while maintenance or setup is performed providing protection without requiring body armor. The hooks 20 are configured to hang or connect to the open barbette door.

Figure 2:
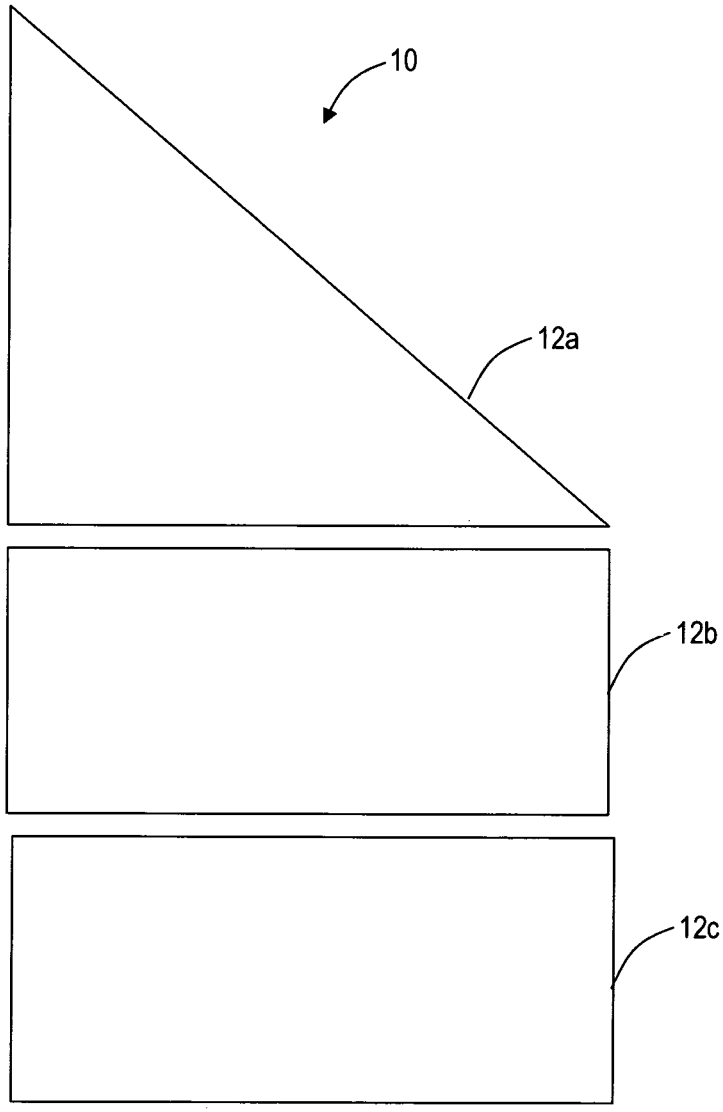
FIG. 2 is a schematic side view illustrates the panel of FIG. 1 in the LPWS application.

Referring to FIG. 2, in an exemplary embodiment, a schematic side view illustrates the panel 10 in the LPWS application. Specifically, in the LPWS application, the panel 10 can include three of the first panels 12*a*, 12*b*, 12*c*, two of the second panels 14, and two of the webbing material 16, 18 along with the hooks 20. FIG. 2 illustrates the panel 10 showing only the first panels 12*a*, 12*b*, 12*c* in the LPWS application. The panels 12*a*, 12*b*, 12*c*, 14 slide into eyelets of the webbing material 16, 18 and the hooks 20 go over a top door of the LPWS creating a saddle bag effect to hold the panels up.

Figure 3:
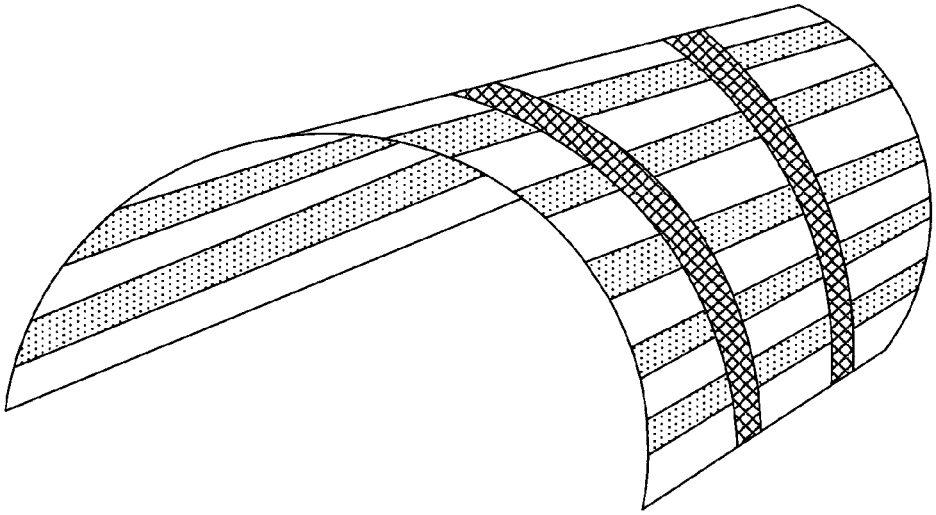
FIG. 3 is a schematic view of the panel FIG. 1 in an arch design.
Figure 4:
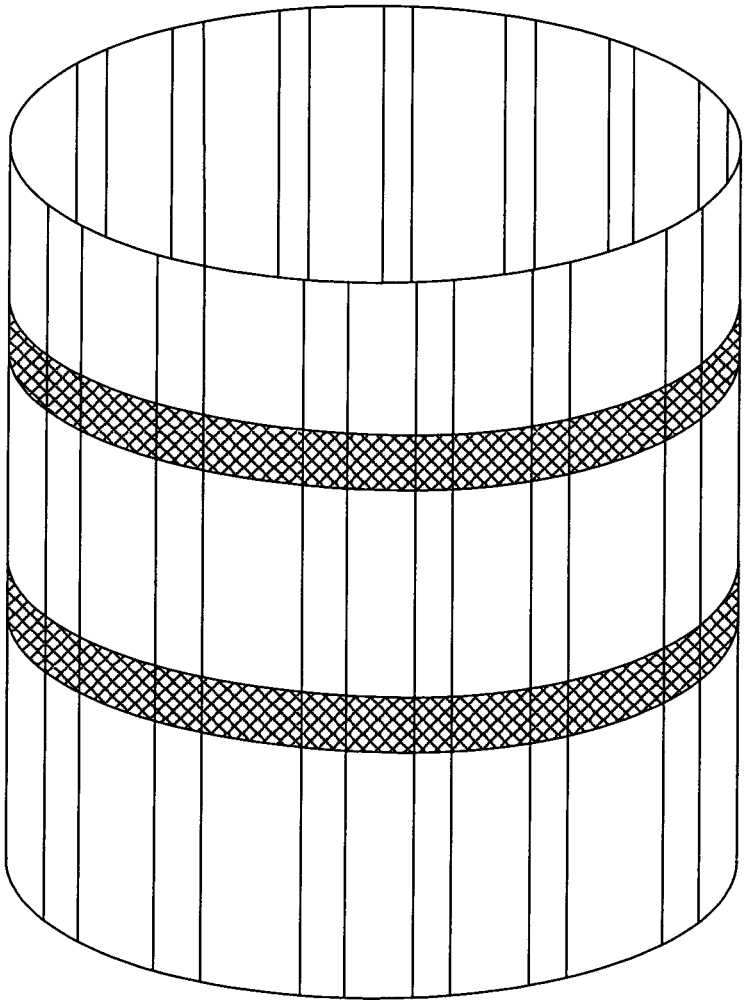
FIG. 4 is a schematic view of the panel FIG. 1 in a circular design.
Figure 5:
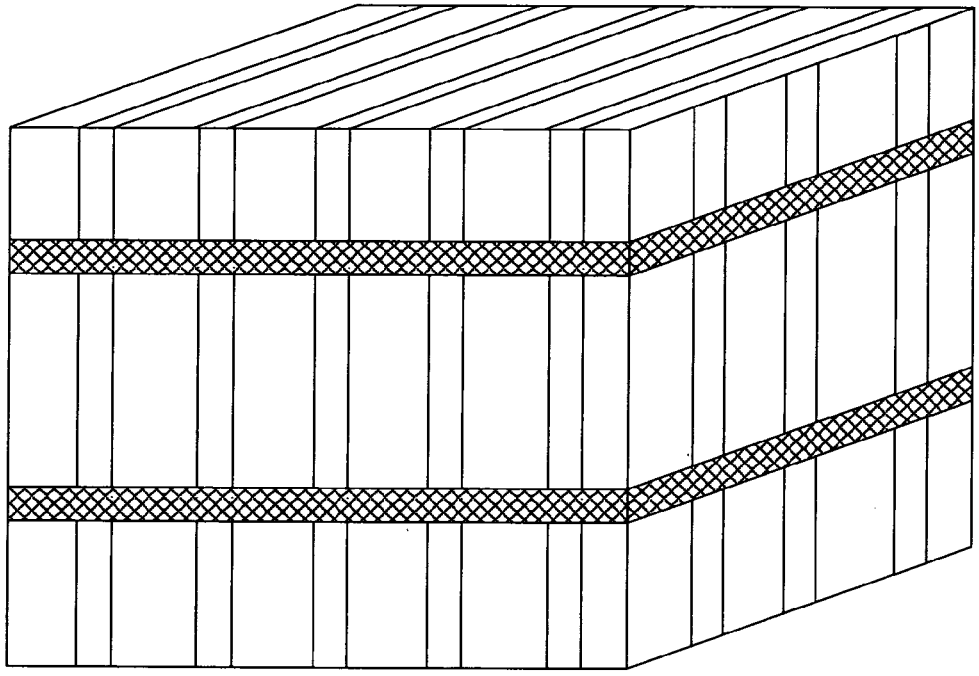
FIG. 5 is a schematic view of the panel FIG. 1 in a rectangular design.

Referring to FIGS. 3-5, in exemplary embodiments, various schematic views illustrate the panel 10 in various, versatile configurations. FIG. 3 is a schematic view of the panel 10 in an arch design. FIG. 4 is a schematic view of the panel 10 in a circular design, and FIG. 5 is a schematic view of the panel 10 in a rectangular design. Those of ordinary skill in the art will recognize with the lap joints, webbing material 16, 18, and an arbitrary number of panels 12, 14 that the Tactical Maintenance Curtain (TMC) is designed to be very versatile for a variety of field applications. In these more universal designs, the panel 10 can include an arbitrary number of 7"×6' panels 12 with the total number determined by the specific need and use, an arbitrary number of 4"×6' panels 14 with the total number determined by the specific need and use, and an arbitrary length of Kevlar webbing material 16, 18 with eyelets to insert the 7"×6' panels and a smaller eyelets to hold the 4"×6' panels.

The arch design is configured to provide fort protection and protected triage cover. Here, the 7"×6' panels 12 are secured together with the webbing material 16, 18 with a ratchet at the end to secure the structures tight and the 4"×6' panels 14 will overlap joints of the 7"×6' panels. A similar design with the ratchet can be used in the circular design to protect a 360 degree area. Also, a similar design may be used with the rectangular design.

Although the present disclosure has been illustrated and described herein with reference to exemplary embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A panel, comprising:

a plurality of first panels, wherein each of the plurality of first panels are rectangular;

a plurality of second panels, wherein each of the plurality of second panels are disposed between a pair of the plurality of first panels via lap joints, and wherein each of the plurality of second panels are rectangular;

at least two webbing straps containing each of the plurality of first panels and the plurality of second panels; and a ratchet being attached to said at least two webbing straps for providing a ratcheting function, wherein each of the plurality of first panels, the plurality of second panels, and said at least two webbing straps are constructed of a material to provide suitable impact protection from bullets and blast fragments.

2. The panel of claim 1, wherein each of the plurality of first panels and each of the plurality of second panels are selectively moveable based on the lap joints and the at least two webbing straps for positioning in a plurality of configurations.

3. The panel of claim 1, wherein each of the plurality of first panels comprise a length substantially greater than a height and a width substantially less than the height and width.

4. The panel of claim 3, wherein each of the plurality of second panels comprise a length substantially greater than a height and a width substantially less than the height and width.

5. The panel of claim 1, wherein each of the plurality of first panels are substantially wider than each of the plurality of second panels with about a same length.

6. The panel of claim 1, wherein each of the plurality of first panels, the plurality of second panels, and the at least two webbing straps are constructed of one of para-aramid synthetic fibers, polyethylene fibers, lightweight high-strength oriented-strand gel spun through a spinneret.

7. The panel of claim 1, further comprising:

a connector being attached to said at least two webbing straps for an attachment purpose.

8. The panel of claim 1, further comprising a connector being formed and adapted for connecting to a door of a field-based system for protection of personnel performing maintenance and setup therein.

9. The panel of claim 1, wherein the plurality of first panels comprise N panels, N being an integer and the plurality of second panels comprise N−1 panels.

10. The panel of claim 1, wherein a length, width, and height of each of the plurality of first panels and the plurality of second panels is selected such that the panel is portable, configurable, and capable of providing suitable impact protection from bullets and blast fragments.

11. A tactical maintenance curtain system, comprising:

a plurality of first panels, wherein each of the plurality of first panels are rectangular;

a plurality of second panels, wherein each of the plurality of second panels are disposed between a pair of the plurality of first panels via lap joints, and wherein each of the plurality of second panels are rectangular;

at least two webbing straps containing each of the plurality of first panels and the plurality of second panels; and a connector being formed for attachment to said at least two webbing straps, wherein the connector is formed and adapted to connect to a door of a field-based system for protection of personnel performing maintenance and setup therein, wherein each of the plurality of first panels, the plurality of second panels, and said at least two webbing straps are constructed of a material to provide suitable impact protection from bullets and blast fragments, and wherein each of the plurality of first panels and each of the plurality of second panels are selectively moveable based on the lap joints and said at least two webbing straps for positioning in a plurality of configurations.

12. The tactical maintenance curtain system of claim 11, wherein each of the plurality of first panels comprise a length substantially greater than a height and a width substantially less than the height and width.

13. The tactical maintenance curtain system of claim 12, wherein each of the plurality of second panels comprise a length substantially greater than a height and a width substantially less than the height and width.

14. The tactical maintenance curtain system of claim 11, wherein each of the plurality of first panels are substantially wider than each of the plurality of second panels with about a same length.

15. The tactical maintenance curtain system of claim 11, wherein each of the plurality of first panels, the plurality of second panels, and the at least two webbing straps are constructed of any of para-aramid synthetic fibers, polyethylene fibers, lightweight high-strength oriented-strand gel spun through a spinneret.

16. The tactical maintenance curtain system of claim 11, wherein the plurality of first panels comprise N panels, N being an integer and the plurality of second panels comprise N−1 panels.

17. The tactical maintenance curtain system of claim 11, wherein a length, width, and height of each of the plurality of first panels and the plurality of second panels is selected such that the panel is portable, configurable, and capable of providing suitable impact protection from bullets and blast fragments.

* * * * *